US005791808A

United States Patent [19]

Nyholm

[11] Patent Number: 5,791,808

[45] Date of Patent: Aug. 11, 1998

[54] SEMI-AUTOMATIC TWISTLOCK

[76] Inventor: Ture Nyholm, P.O. Box 452, South Yarra, Victoria 3141, Australia

[21] Appl. No.: 814,840

[22] Filed: Mar. 11, 1997

[30] Foreign Application Priority Data

Mar. 11, 1996 [AU] Australia ..... PN8577

[51] Int. Cl.[6] ..... F16B 21/00

[52] U.S. Cl. ..... 403/325; 403/348; 403/385; 411/552; 411/553; 24/136 R; 24/287

[58] Field of Search ..... 403/385, 396, 403/384, 322, 325, 24, 348, 350; 411/551, 552, 553, 349, 549; 24/136 R, 136 K, 287, 453; 220/1.5

[56] References Cited

U.S. PATENT DOCUMENTS

| | | | |
|---|---|---|---|
| 3,456,967 | 7/1969 | Tantlinger et al. | 24/287 |
| 3,691,595 | 9/1972 | Backteman | 24/287 |
| 4,196,673 | 4/1980 | Looks | 24/287 X |
| 4,782,561 | 11/1988 | Hayama | 24/287 |
| 5,062,752 | 11/1991 | Takaguchi | 24/287 X |
| 5,193,253 | 3/1993 | Janke et al. | 24/287 |
| 5,362,586 | 11/1994 | Nyholm | 411/552 |

FOREIGN PATENT DOCUMENTS

WO 92/05093 4/1992 WIPO .

*Primary Examiner*—Harry C. Kim
*Assistant Examiner*—William L. Miller
*Attorney, Agent, or Firm*—Merchant, Gould, Smith, Edell, Welter & Schmidt, P.A.

[57] ABSTRACT

A semi automatic twistlock for engagement with corner castings of ISO containers is operated by a cable. The cable extends around a shaft journalled in a housing, to rotate the cones that arc fixed to opposite ends of the shaft. The cable is extended or retracted though an operating channel and is biased to the retracted position by a spring coupled to the cable on an opposite end of the cable. The cable has a collar which can engage with a first or second stop formed in the operating channel or can remain disengaged in the fully retracted position to thereby permit selective positioning of the cones relative to the shaft.

9 Claims, 6 Drawing Sheets

SEMI-AUTOMATIC TWISTLOCK

BACKGROUND OF THE INVENTION

This invention relates to a twistlock of the type for locking together adjacent corner castings of shipping containers and in particular to a twistlock that is actuable by a cable mechanism.

Twistlocks are used to secure together adjacent shipping containers for stability of the cargo during a voyage and are used especially to lock together two containers in vertical relationship.

Such twistlocks generally comprise a housing with a shaft journalled through the housing and having a cone on opposite ends of the shaft, which are rotatable on opposing sides of the housing. The housing is located between adjacent containers and the cones are locked within a respective corner casting. Cones can be inserted through elongate slots of the corner castings into an interior of the corner casting, and then rotated to bear against the inside of the casting adjacent to the slot.

The procedure generally used for fastening containers together is somewhat complex and hazardous. This is generally done manually where the first container is put into place and a longshoreman mounts a row of containers and on each top corner casting locks the first cone of a twistlock, a second container is then lowered onto the first, and the second cone is then manually twisted to lock the upper container into position.

This presently employed procedure is quite physically difficult, requiring two actions, firstly positioning the twistlock and secondly locking the twistlock the containers being of some considerable height. The manual operation also results in damage to the twist locks because when they are to be removed the twistlocks are thrown onto the deck, and the impact on the deck can result in damage to the twistlock.

Coming into vogue are so-called semi-automatic twistlocks where the shaft is biased to a locked position so that a first cone of tie twistlock is locked into position, and a second of the cones can be forced into an unlocked position by reason of weight of the container bearing down on the sloped sides of the cone, twisting the cone through the slot and then the cone snapping back into a locked position. The semi-automatic twistlock has the advantage that only one of the steps is required for locking containers together.

The procedure for unlocking however still remains the same, usually a tool is operated from ground level to operate an actuation device on the twistlock to unlock usually one of the cones. Generally such actuation devices are in the form of a lever extending out of the housing and an appropriate tool that can be operated from the dock to contact the lever to move it. A difficulty with levers is however that these protrude past an edge of the container and may catch during unloading of containers or damage may result during general handling of the twistlock.

It is desired to be able to unlock one of the cones whilst the other of the cones is still engaged. This can be achieved by having the cones with an elongate axis differently aligned to each other so that when one of the cones aligns to its respective slot, and is releasable, the other is still somewhat angled thereto, and therefore engaged it its respective slot. Such dual acting twistlock have also come into use by reason of variations in regulations from country to country requiring the twistlock to be unloaded onto shore or alternatively to remain on board during unloading cargo onto a dock.

It has been proposed in WO 92/05093 to provide an actuation device for a twist lock in the form of a wire instead of the conventional lever mechanism. The proposal however has several deficiencies. Firstly a rather complex biasing means is required to bias the cable into a retracted position. The precise mechanism is not disclosed however a complex radially expanding spring arrangement is required. Furthermore the mechanism for engaging the cable at two differently extended positions is somewhat awkward, because the collar or stop crimped onto the wire interferes with extending the cable past the nozzle. This is due to the fact that when the cable is operated from the ground inevitably some downward pull is exerted whilst the collar is within the nozzle, and which downward pull forces the crimped collar to bear against the sides of the nozzle and interferes with extension of the cable into the locked position outside of the nozzle.

An object of the present invention is to provide a twistlock that obviates or minimises at least one of the aforementioned problems in a simple yet effective way, or at least provides the public with a useful choice.

SUMMARY OF THE INVENTION

In one form, but not necessarily the broadest or only form the invention could be said to reside in a semi-automatic twist lock comprising

- two cones fixed to opposite ends of a shaft, the shaft being supported for rotation within a housing,
- a cable having a first free end protruding from the housing through an operating channel and including gripping means by which the cable can be pulled so as to extend further out of the housing,
- said cable including shaft engaging means engaging said shaft so that on movement of the cable the shaft rotates.
- a limit means to limit the extent of rotation of the shaft, between a fully retracted position of the cable and a fully extended position of the cable,
- a resilient connection means contacting the cable at a portion distal from the free end relative to the shaft said resilient connection means biasing the cable into a retracted position and located within said operating channel being first and second stop means each positioned in spaced apart relationship relative to the cable, the cable including a stop engaging means fastened thereto, for engagement on either the first or the second stop means against the resilient support means,
- both cones being in an engaging position when the cable is in a fully retracted position, and a first of the cones being in a released position when said stop engaging means is engaged to die first stop means, and a second of the cones being in a released position when said collar is engaged to the second stop means.

In one form said operating channel has side walls diverging outwardly and upper and lower walls joining to said side walls, said first and second stop means positioned adjacent opposite side walls, so that the cable can be guided to engage one or other of the two stop means, preferably the lower walls extend past both the first and the second stop means such that the stop engaging means is supported by the lower wall when in the engaged position.

Preferably the cable is wrapped around the shaft at least once fully, and said shaft engaging means engages simply in response to a withdrawal of the cable. This minimises the stress acting on any lug or aperture of the shaft engaging means. It can be appreciated that the magnitude of sudden strains on the shaft engaging means is quite great when the weight of the upper container impacts on the upper cone and the shaft, and then is suddenly released as the cone snaps back to the engaging position within the corner casting.

BRIEF DESCRIPTION OF THE DRAWINGS

For a better understanding of the invention it will now be described with reference to one embodiment of the invention which will now be described with reference to the drawings in which.

DETAILED DESCRIPTION OF THE DRAWINGS

Figure 1:
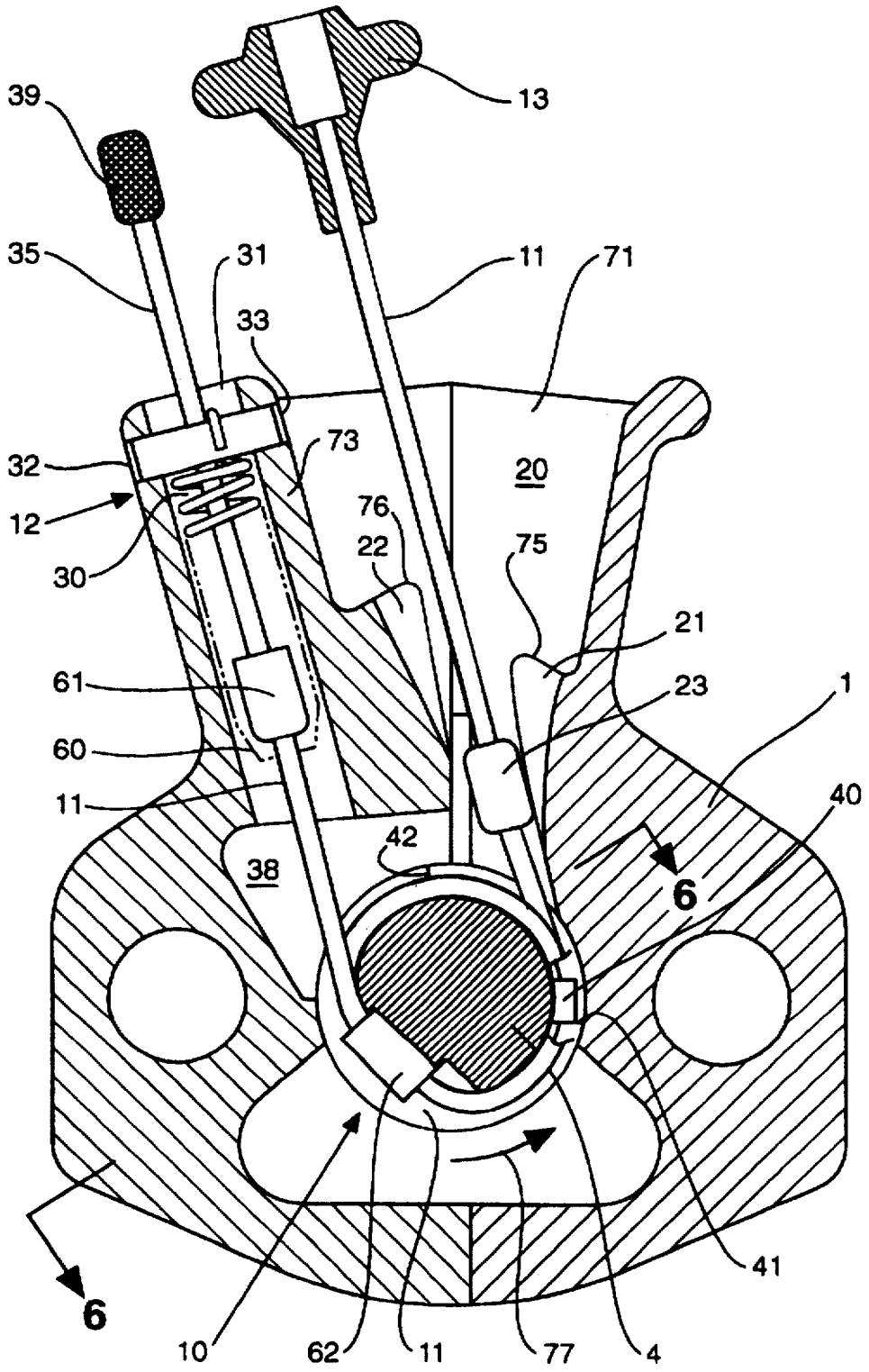
FIG. 1 is a cutaway cross-sectional view showing the component parts and general layout of the illustrated twist lock.
Figure 2:
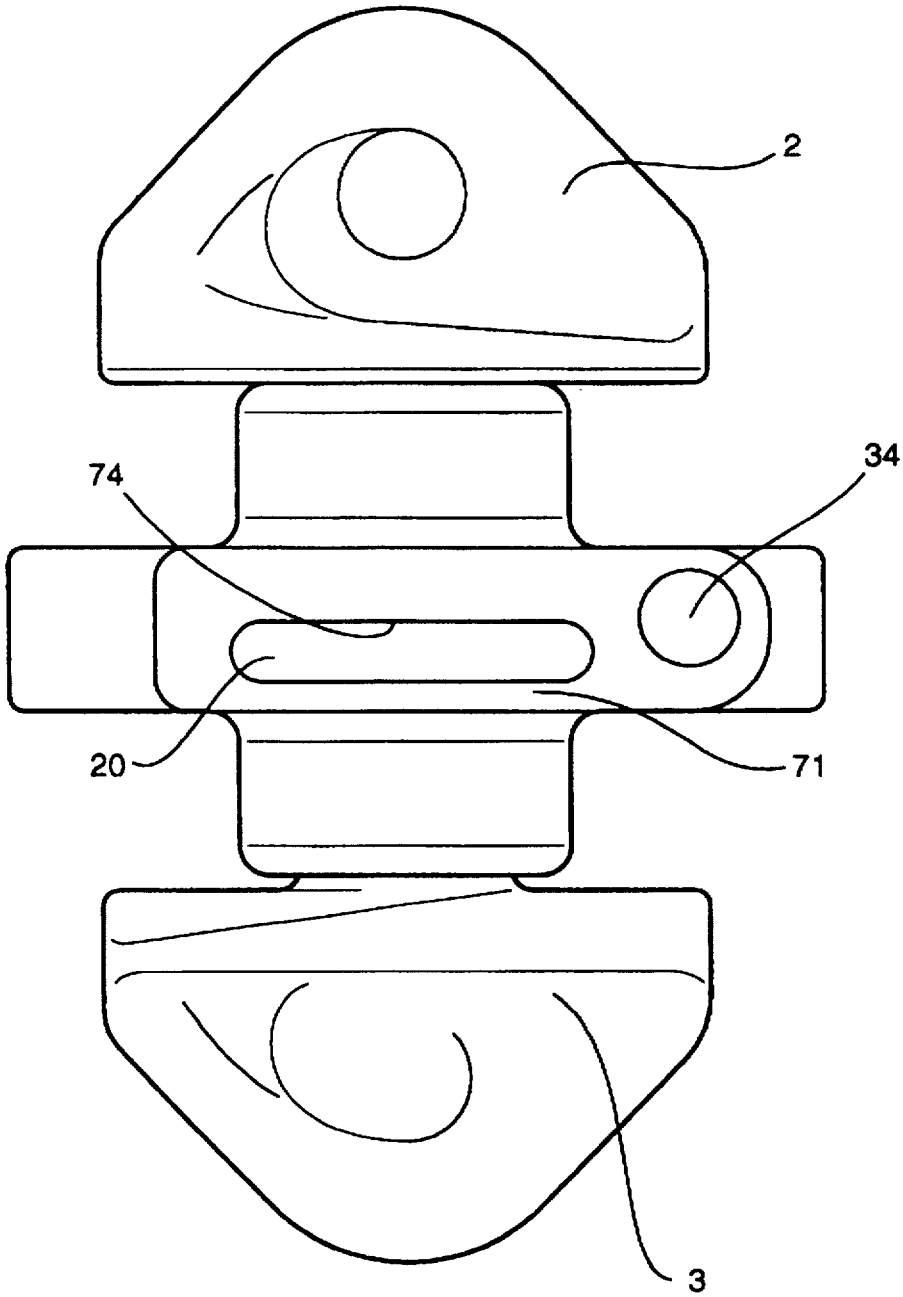
FIG. 2 is a view from the front of the twistlock showing the position of the operating channel within the housing.

Similar reference characters indicate corresponding parts throughout the several views of the drawings.

Dimensions of certain of the parts as shown in the drawings may have been modified and/or exaggerated for the purposes of clarity of illustration.

The illustrated twistlock comprises a housing 1 cast from steel in two pieces which has been galvanised and bolted together. The twistlock includes two cones 2 and 3, the cones being fixed onto a shaft 4, each of the cones being offset to one another relative to the shaft. The shaft and cones are forged as one piece and are galvanised. The shaft is supported for rotation within the housing. The shaft is engaged via an engagement means 10 to a cable 11. The first free end of the cable has a handle 13 attached so that either a tool can be used to extend the cable, or that the handle can be grasped directly and pulled out. The cable is moveable between a retracted position and an extended position, and is biased to the retracted position by a resilient connection 12 between the cable and the housing.

The cable passes out of the housing through an operating channel 20, which operating channel includes two stop means 21, and 22, each spaced apart along the length of the cable. A stop engaging collar 23 is fastened to the cable, which collar can be engaged on one or other of the stop means so that the shaft and therefore the cones can each be locked into one of two rotated positions whereby one or other of the cones is in the unlocked position, or alternatively the collar can be totally released such as shown in FIG. 1 whereby both cones are in the locked position.

The resilient connection 12, comprises a coil spring 30, extending from a post 31 towards the interior of the housing. The cable is captured by a reducing coil 60 of the spring which engages a second collar 61. When the cable is urged in the direction of the interior by pulling handle 13 the second collar is restrained by the coil spring and the first free end of the cable is biased to the retracted position. It can be seen therefore that a single spring biases both the cable and at the same time the shaft. The resilient connection is directly to the cable and contacts the cable at a portion distal from the first free end relative to the shaft. It will therefore be appreciated that this permits for a quite simple construction.

The pin 31 passes through aligned apertures 32, and 33. In the case of emergency, the pin 31 can be knocked out thereby releasing the spring, to allow the cones to be moved manually. This mounting of the spring facilitates replacement where any damage might occur, or where perhaps material has lodged jamming the spring and thereby the cable.

A second free end of the cable 35 passes through a further aperture 34 in the housing, from an interior chamber 38 of the housing. The second free end of the cable protrudes away from the housing and has an indicator 39 fixed on it. The indicator is a brightly coloured cap that is visible, and when extended away from the housing indicates that the cones are in a locked position, whereas when the indicator is positioned close to the housing, indicates that one or other of the cones is released.

Figure 7:
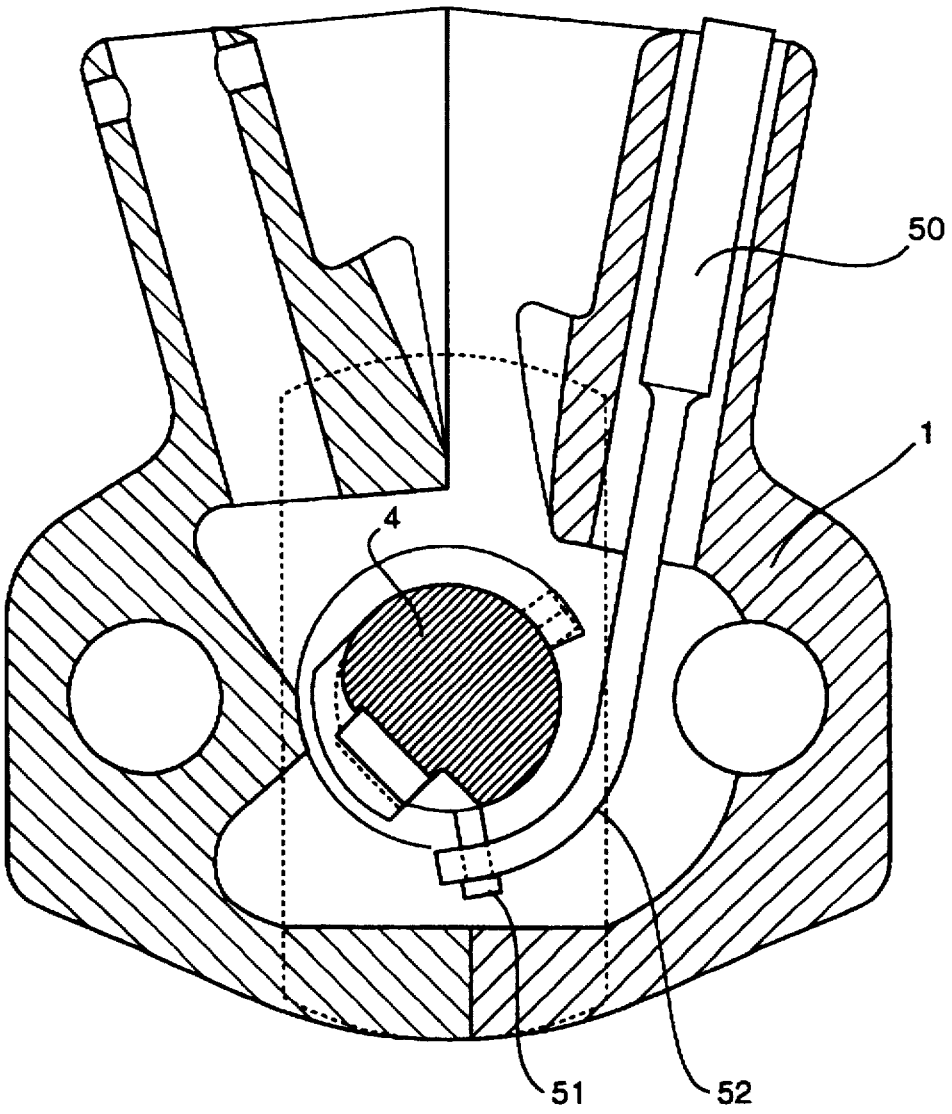
FIG. 7 is a cut away cross-sectional view similar to that shown in FIG. 1 of a second embodiment with an alternate indicator; the cable is not shown.

Alternatively as is shown in FIG. 7 a quite separate indicator 50 can be separately attached to the shaft by pin 51. The indicator is supported on a flexible plastics cable 52. Its operation is quite similar to that of the first embodiment.

Figure 6:
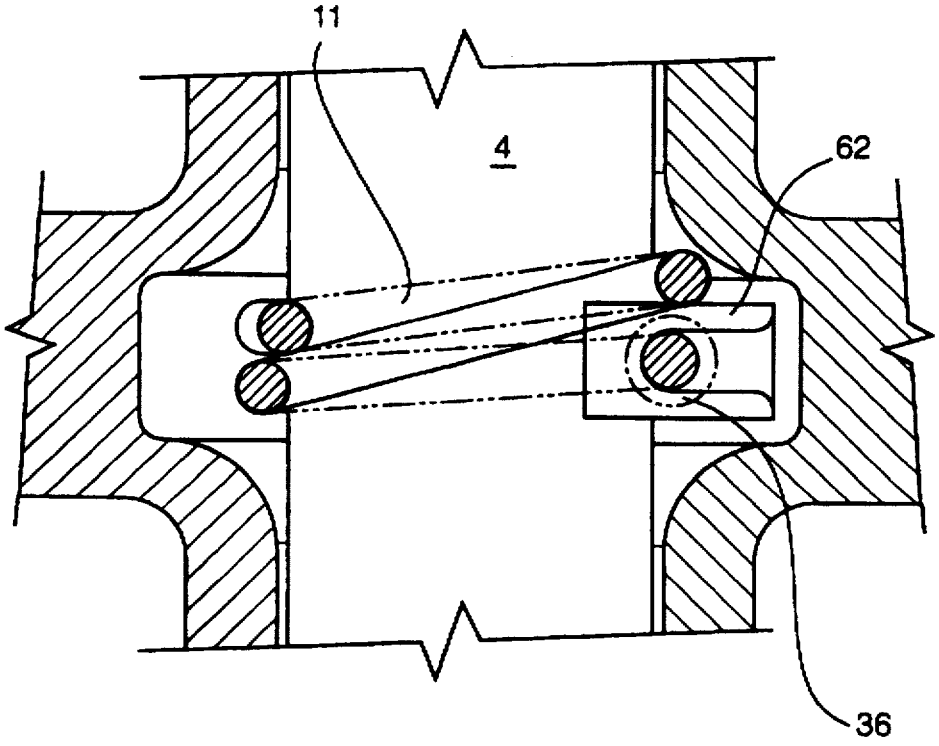
FIG. 6 is a cross sectional view through VI—VI of FIG. 1 showing detail of the engagement means for the cable to engage with the shaft.

The cable extends from the second free end 35 around the shaft 4, the cable is wrapped around the shaft totally once before extending through operating channel 20. An engagement means 10 is provided in relation to the shaft and includes a slotted tab 62 fixed to the shaft; the cable being positioned in place by passing through the slot. This is best seen in FIG. 6. A third collar 36 mounted to the cable bears against an end wall of the slotted tab as a result of the action of the spring 30.

The extent of rotation of the shaft is limited by a post 40 extending into a complementary circumferential groove within an adjacent part of the housing. The rotation of the shaft is thereby limited within the circumferential groove ending at 41 and 42. As shown in FIG. 1 the fully retracted position, is determined because post 40 bears against end 41. The fully extended position is determined by end 42, which is so positioned that spring cannot be overextended.

An aperture 70 opens from the interior chamber into operating channel 20. The operating channel is defined in plan view as a funnel shaped, having a flat lower wall 71, two vertical sides 72, 73 and an upper wall 74. The stop engaging collar 23 is fixed to the cable 11, and can be engaged by either a first stop 21, or a second stop 22. The first stop and the second stop are both slotted tabs extending into the operating channel from sides walls defining the channel. So that when engaged the stop engaging collar engages against end surfaces 75 and 76 respectively whilst the cable passes through the slot.

In use on a container ship the lowermost cone 3 is inserted within the slot of a corner casting and the housing of the twist lock is turned so that the lower cone is locked into position in that casting. The top container is then lowered onto the bottom container the sides of the slot of the respective corner castings bear against the sides of the cones to force them into firstly an unlocked position to allow passage through the slots, and thereafter, the cones snap back by reason of the tension provided by spring 30 into a locked position.

To take off the containers it may be desired, depending upon where the unloading is to take place, to either unlock the upper container only so that the upper container can be lifted without a twist lock being connected, or alternatively to unlock only the lower container, so that the twistlock is maintained on the upper container, but released from the lower container, and therefore taken ashore.

Figure 3:
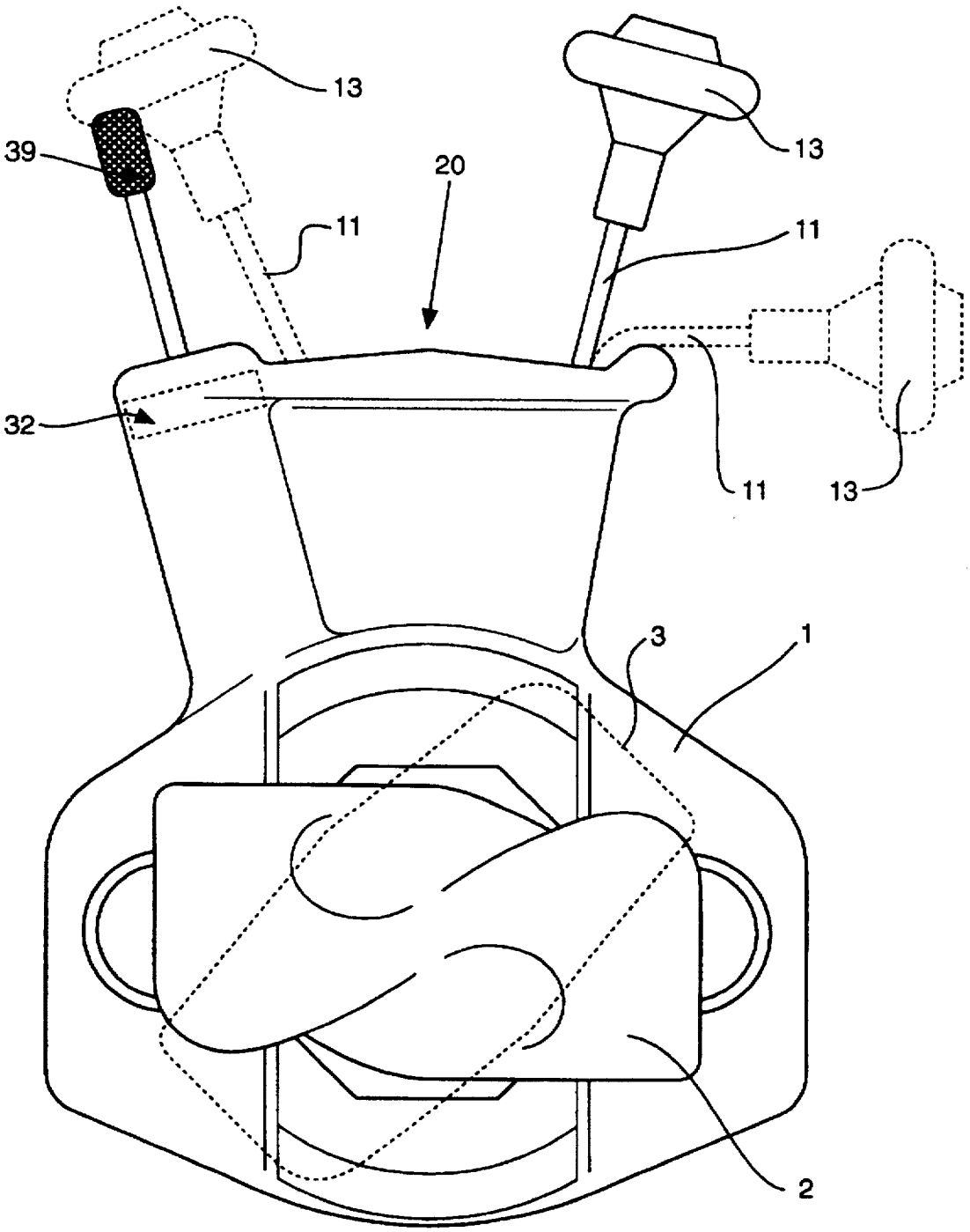
FIG. 3 is a view from above the twistlock, showing the relative position of the top cone, the bottom cone, the indicator and the actuation cable.
Figure 4:
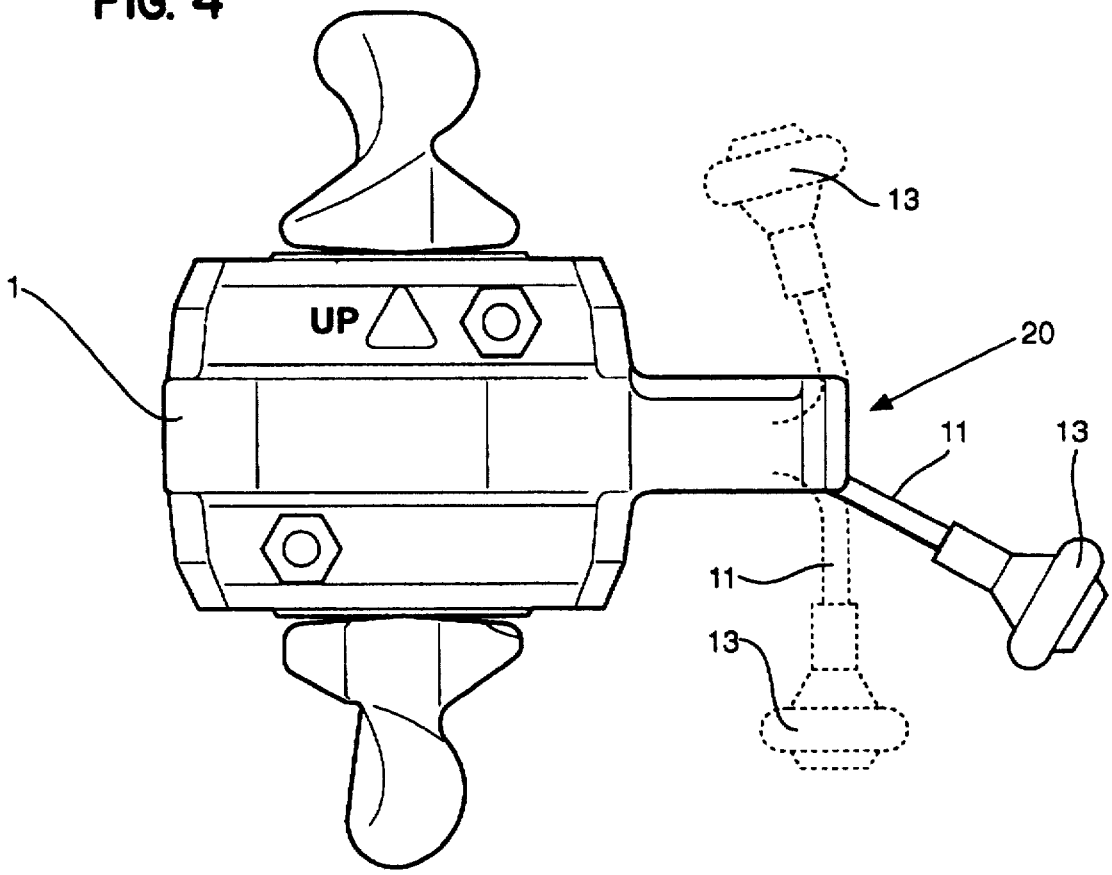
FIG. 4 is a view from one side showing the flexibility of the actuation cable relative to the housing and operating channel.
Figure 5:
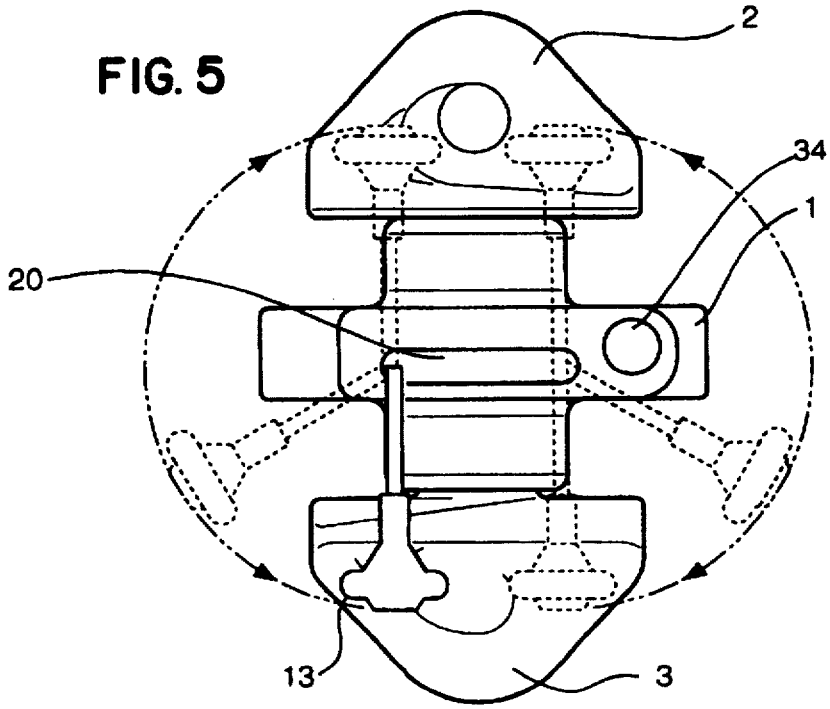
FIG. 5 is a view from the front of the twistlock showing the flexibility of the actuation cable relative to the housing and the operating channel.

The elongate cones are not aligned, as can perhaps best be seen in FIG. 3 and as a result where the lowermost cone is in an un-engaged position, the upper most cone is still in an engaged position. When the 13 handle is pulled the shaft turns in the direction of arrow 77 and the stop engaging collar 23 is supported on the end surface 75 of the first stop 21 then only the lowermost cone 3, is in a disengaged position being aligned with the elongate slot of its corner casting. When in that position it can be withdrawn from the corner casting. When the handle is pulled further and the stop engaging collar is supported on the end surface 76 if the second stop 22 then only the uppermost cone 2 is in a disengaged position. Thus where it is desired to take the twistlock ashore, the handle is pulled only to the first position, and when it is desired to leave the twistlock on top of the lowest container the handle is pulled to the second position. This then allows for maintaining the cone in either of two positions.

It can be seen that the side walls 72, and 73 of the operating channel 20 diverge in the direction of opening, and that the first stop 21 is formed out from a first of the side walls 72, whereas the second stop is formed out from a second of the side walls 73. It will be appreciated therefore that this facilitates greatly locating either the first or the second stop, and that there will be no uncertainly as to which of the stops are engaged. Therefore when manipulating a twistlock on top of a container, and subsequently lifting the container, error is thus minimised.

It can also be seen that the flat lower wall 71 extends well past the second stop 22, it also extends past the furthest extension of the stop engaging collar 23 when the cable is fully extended, as determined by post 40 being against the end 42 of circumferential groove. Thus the stop engaging collar is maintained on top of the even surface of the flat lower wall 71. It is found if this is not maintained there is a risk of the collar catching and consequently the twistlock fouling, requiring a longshoreman to attend to unjamming the twistlock.

I claim:

1. A semi-automatic twist lock comprising two cones fixed to opposite ends of a shaft, the shaft being supported for rotation within a housing, a cable having a first free end protruding from the housing through an operating channel and including gripping means by which the cable can be pulled so as to extend further out of the housing, said cable including shaft engaging means engaging said shaft so that on movement of the cable the shaft rotates, a limit means to limit the extent of rotation of the shaft, between a fully retracted position of the cable and a fully extended position of the cable, a resilient connection means contacting the cable at a portion distal from the free end relative to the shaft, said resilient connection means biasing the cable into a retracted position, and located within said operating channel are first and second stop means each positioned in spaced apart relationship relative to the cable, the cable including a stop engaging means fastened thereto, for engagement on either the first or the second stop means against the resilient support means, both cones being in an engaging position when the cable is in a fully retracted position, and a first of the cones being in a released position when said slop engaging means is engaged to the first stop means, and a second of the cones being in a released position when said stop engaging means is engaged to the second stop means.

2. The semi-automatic twistlock as in claim 1 wherein said operating channel is defined within side walls and upper and lower walls joining to said side walls, said first and second stop means positioned adjacent opposite said side walls, so that the cable can be guided to engage the first or second stop means by guiding the cable to a respective said side wall.

3. The semi-automatic twistlock as in claim 2 wherein the lower wall extends past both the first and the second stop means such that the stop engaging means is supported by the lower wall when in the engaged position.

4. The semi-automatic twistlock as in claim 1, wherein the cable is wrapped around the shaft at least once and said shaft engaging means engages simply in response to a withdrawal of the cable.

5. The semi-automatic twistlock as in claim 1 wherein the resilient connection means is in the form of a spring extending along the distal portion of the cable, and including a tapered portion at a first end of the spring, said spring being tapered in the direction of extension so as to engage the cable when being extended out of said housing, a second end of the spring captured on a pin extending through the housing, whereby the resilient connection means can be released on release of said pin.

6. The semi-automatic twistlock as in claim 3 wherein the gripping means is flexibly spaced from the stop engaging means so that it can be easily pulled in a plane different than that of the lower wall of the operating channel and the extension of the cable is limited so that said stop engaging means does not extend beyond the lower wall of the operating channel.

7. The semi-automatic twistlock as in claim 1 wherein an indicator means is linked with rotation of the shaft, said indicator means extending through an indicator aperture to an exterior of the housing, said indicator means extending or retracting with rotation of the shaft to give a visible indication of the position of the cones.

8. The semi-automatic twistlock as in claim 2 wherein the cable is wrapped around the shaft at least once and said shaft engaging means engages simply in response to a withdrawal of the cable.

9. The semi-automatic twistlock as in claim 3 wherein the cable is wrapped around the shaft at least once and said shaft engaging means engages simply in response to a withdrawal of the cable.

* * * * *